United States Patent [19]

Holcroft

[11] 4,133,284

[45] Jan. 9, 1979

[54] COOLING SYSTEM FOR MARINE ENGINES

[75] Inventor: William L. Holcroft, Anaheim, Calif.

[73] Assignee: George Hashimoto, Gardena, Calif.

[21] Appl. No.: 806,712

[22] Filed: Jun. 15, 1977

[51] Int. Cl.[2] ..... B63H 11/02

[52] U.S. Cl. ..... 115/75; 115/14; 60/221; 123/41.08

[58] Field of Search ..... 115/75, 11, 12 R, 14, 115/16; 123/41.02, 41.08, 41.09, 41.45; 415/366, 369, 370, 371; 60/221

[56] References Cited

U.S. PATENT DOCUMENTS

| | | | |
|---|---|---|---|
| Re. 26,400 | 6/1968 | Jasper | 123/41.08 |
| 3,358,654 | 12/1967 | Shanahan | 123/41.08 |
| 3,742,895 | 7/1973 | Horiuchi | 115/12 R |
| 3,780,712 | 12/1973 | Pace | 123/41.08 |
| 3,993,015 | 11/1976 | Klepacz | 115/14 |

*Primary Examiner*—Trygve M. Blix

*Assistant Examiner*—D. W. Keen

*Attorney, Agent, or Firm*—Charles H. Schwartz

[57] ABSTRACT

A cooling system for marine engines for use in propelling a boat and wherein the propulsion system provides a flow of water to the engine for cooling and wherein the water is provided at a range of pressures including a high pressure, the cooling system including a pressure regulator for receiving the flow of water from the propulsion system and for providing this flow of water to the engine for cooling and with the pressure regulator providing the flow of water to the engine at a pressure substantially less than the high pressure from the propulsion system, a thermostat located to receive water from the engine and for regulating the flow of water from the engine in accordance with the temperature of the water from the engine, and the thermostat providing a minimum flow of water from the engine even when the water is at its coldest temperature.

8 Claims, 5 Drawing Figures

COOLING SYSTEM FOR MARINE ENGINES

The present invention is directed to a cooling system for marine engines. Specifically, the present invention is directed to a temperature regulated cooling system for inboard engines such as used with water jet drive systems or for in- and outboard engines as used with a propellor drive, but it is to be appreciated that the invention may be used with any engine that normally uses a flow through high pressure cooling system.

The cooling system of the present invention may be used for engines installed on boats either for fresh or salt water and the cooling system provides specific regulation of engine temperature depending on whether the boat is to be used in fresh or salt water.

As a specific example, the regulated cooling system of the present invention is directed for use in cooling automobile engines which are converted to marine use. Automobile engines, when used for marine purposes, normally suffer from low operating temperatures. This creates difficulties in the use of these engines since the engines were normally designed to operate at greater temperatures such as 180° F to 230° F. When operated within the desired temperature range, these engines provide for maximum efficiency in the use of the engines and for maximum reduction of exhaust pollution.

The reason that the engines are operated at relatively low operating temperature is because these engines normally derive their cooling from a continuous high pressure full flow of water through the cooling chamber in the engine. The cooling water will therefore continuously maintain the operating temperature too low even though the coolant may be preheated by running the coolant through the exhaust manifold prior to running through the engine itself. For example, in a system where an automobile engine is used to drive a jet pump to provide for propulsion of the boat, the impeller on the jet drive unit produces a jet of water and a portion of this jet is tapped and is used to supply a full flow of water through the automobile engine. In the in- and outboard systems, a pump on the in and out drive is used to supply a full flow of water through the engine.

In either of the above cases, the pressure output of water through the engine can range from a relatively low pressure when the boat is stationary to a high pressure such as one hundred pounds per square inch when the boat is moving. Since the pressure is most often quite high, it would not be possible to just insert a thermostat in the water line as is normally done with a closed cooling system in automobile engines. If a thermostat was merely put in the line, this could create such severe pressures within the cooling chamber so as to blow out the soft plugs in the engine.

There have been prior art cooling systems which use relief valves so as to relieve the pressure, but at the same time that the pressure is relieved, the volume of water is reduced. Unfortunately, it is necessary to have a reasonable flow of water volume from the engine since normally the water is mixed with the exhaust gases so as to cool the exhaust gases before the combination of exhaust gases and water is expelled from the back of the boat. If the water is not mixed with the exhaust gases, the exhaust gases could be so hot as to create problems with the ducts that are used to lead the exhaust gases to the rear of the boat.

The present invention provides for a cooling system for engines, such as automobile engines, used for marine use wherein the full flow of water from either the jet pump or the pump in the in- and outboard drive is first passed through a pressure regulating valve. This pressure regulating valve reduces the pressure to a relatively low fixed value, yet maintains the proper volume of water flow through the engine. Once the pressure has been reduced to a proper level, then it is possible to install a thermostat of a specific design so as to obtain an operating temperature of the engine at a much higher temperature than would be possible with the prior art cooling systems.

For example, for a marine engine for use in fresh water, the operating temperature can range between 150° F to 190° F. For an engine for use in salt water, it is necessary that the temperature be restricted to no higher than 140° F since above this temperature salt starts to crystallize and can therefore corrode the interior of the engine. In either case, the increased temperature operation provides for significant advantages in the operation and life of the engine.

For example, if the engine is operated at the increased temperature, this increases the durability and prolongs the life of the engine. In addition, the engine lubrication is at its maximum efficiency with increased temperature operation. Also, for an engine operated at an increased temperature, fuel consumption is reduced along with maximum efficiency of the fuel being burned. In a cold running engine, more fuel is burned with less efficiency. If the engine operates more efficiently, and the fuel is burned more efficiently, a cleaner exhaust is provided which, in turn, cuts down on air pollution. Another advantage of controlling the temperature is that a more finer tuning of the engine can be achieved which, in turn, increases the improvements listed above.

As indicated above, the present invention provides for the use of a pressure regulator to reduce the pressure of the water coolant which is normally provided for the engine. With this reduced pressure, it is then possible to include a modified thermostat in the cooling system. Specifically, the thermostat is normally inserted at the exit of the water coolant from the engine. Since the water coolant from the engine is used to cool down the exhaust gases, it is necessary to supply a flow of water even when the engine is cold. Normally, when the engine is cold, the thermostat would be in a fully closed position. The thermostat used with the cooling system of the present invention includes means such as openings through the thermostat so that at all times a minimum amount of water passes out of the engine to mix with the exhaust gases. However, the flow is restricted enough so that the engine is allowed to warm up to an increased operating temperature. Since the water pressure has been reduced prior to entering the engine, there is no danger that even with the restricted flow the pressure will increase significantly so as to create a problem within the engine.

A clearer understanding of the invention will be had with reference to the following description and drawings wherein FIG. 1 illustrates a boat incorporating an engine having a cooling system constructed in accordance with teachings of the present invention;

Figures 1, 5:
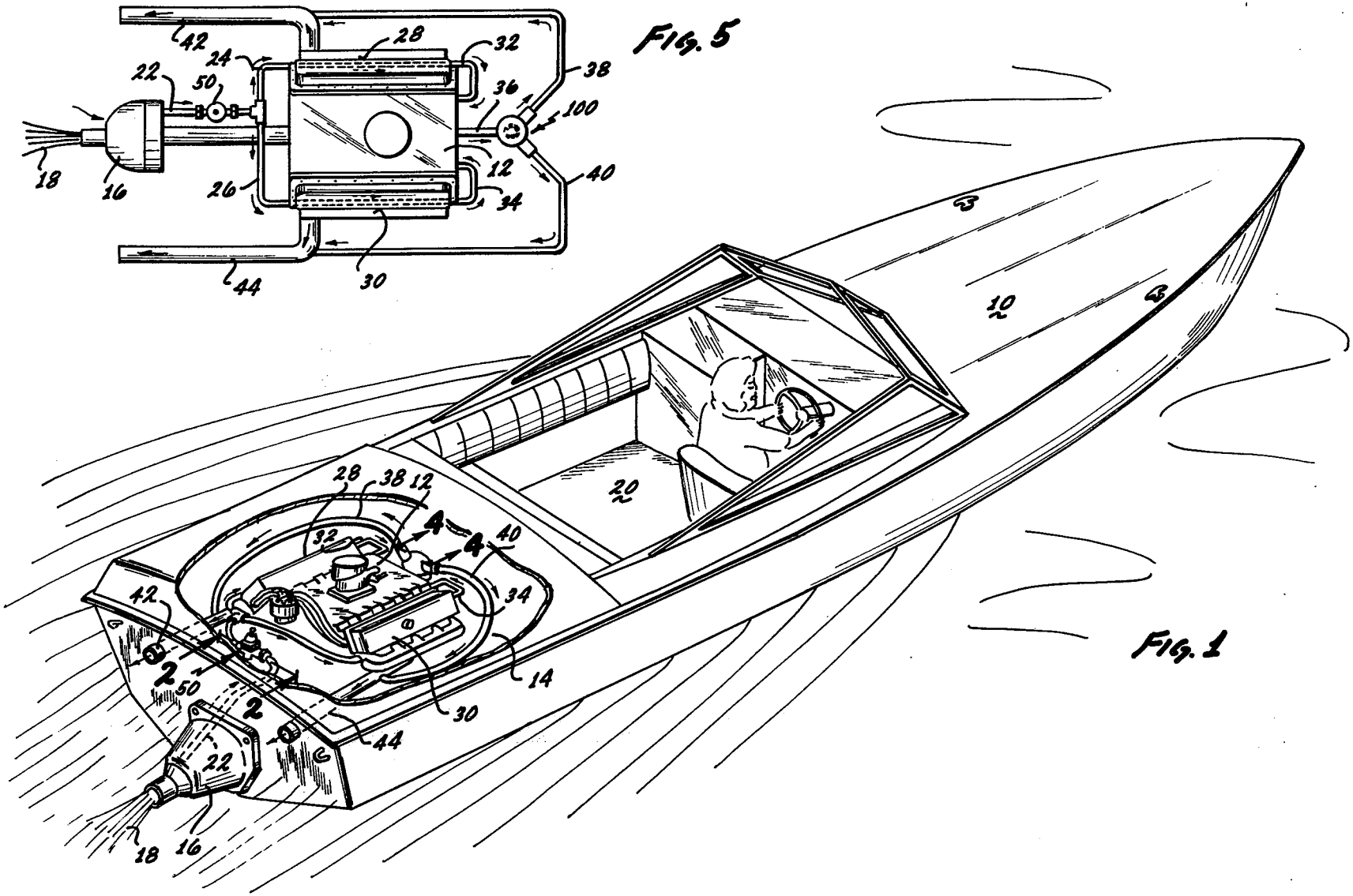
FIG. 5 illustrates a flow diagram for the cooling system of the present invention.

In FIG. 1, a boat 10 is powered by an engine 12 located at the rear of the boat 10 in a well 14. The engine 12 drives a jet pump 16 which produces a jet of water 18 to propel the boat. The operator of the boat may sit in a cockpit 20 and control the boat from this position.

As shown in FIG. 5, the jet of water is tapped by line 22 to supply cooling water for the engine 12. Specifically, the line 22 is branched into branch lines 24 and 26 and the cooling water is first passed into branch lines 24 and 26 and the cooling water is first passed through exhaust headers 28 and 30 to initially raised the temperature of the cooling water by the exhaust gases collected by the exhaust headers 28 and 30. The cooling water then passes out of the exhaust headers 28 and 30 through water lines 32 and 34 and enters the cooling chambers within the engine 12 in a known fashion.

The water cools the engine during operation of the engine and exits the engine through an exhaust line 36. The exhaust coolant is then again split into two lines 38 and 40 and is mixed with the exhaust gases in the exhaust lines 42 and 44. The mixture of the exhaust water and exhaust gases is necessary so as to reduce the temperature of the exhaust gases. As shown in FIG. 1, the combination water and gas exhaust is exited at the rear of the boat. If the exhaust gases are not cooled by the exhaust water, this could lead to very high temperatures in the exhaust tubing 42 and 44.

In the prior art systems the cooling system as described above would be provided with a full flow of coolant through the engine. This would supply maximum coolant but the engine would always run cold and, as indicated above, running the engine cold reduces the efficiency, durability and increases air pollution within the exhaust. The present invention provides for an improved cooling system so as to allow the engine to run at an increased temperature while still providing for the proper reduction of the temperature of the exhaust gases.

Specifically, the present invention includes the use of a pressure reducing valve 50 in the water line 22 so as to reduce the water pressure to a level such as a range of fifteen to twenty-five pounds per square inch pressure. This output pressure is maintained by the pressure reducing valve 50 as the input pressure from the jet pump 62 ranges over a range of water pressure including high pressures of up to and even greater than 100 psi.

Figure 2:
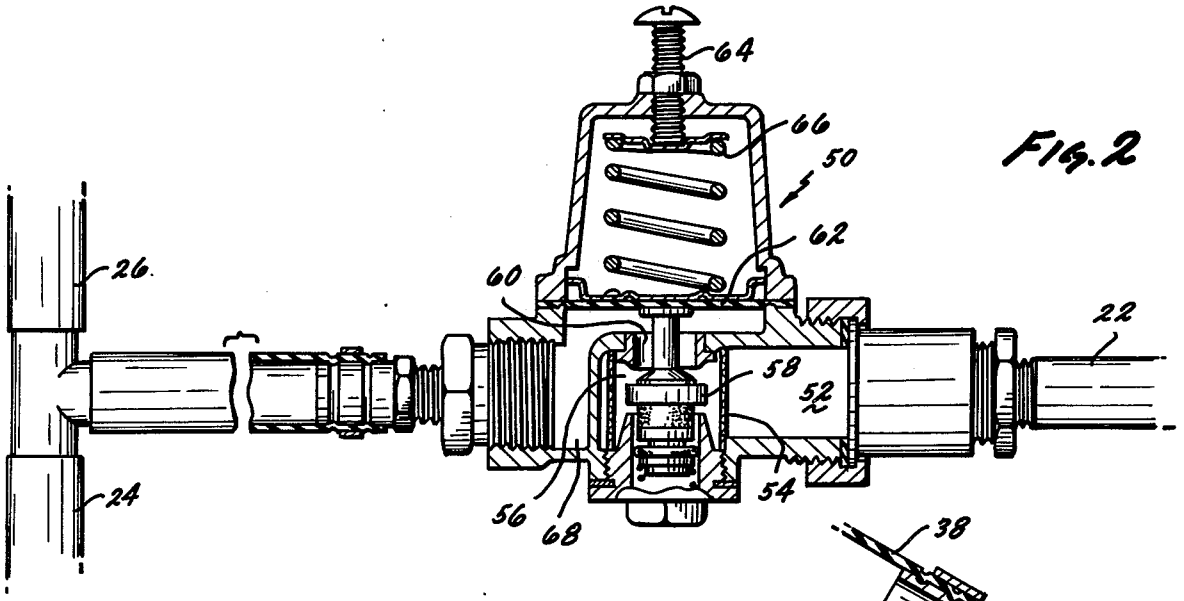
FIG. 2 is a cross-sectional view of a pressure regulating valve which may be used with the cooling system of the present invention.

As shown in FIG. 2, the pressure reducing valve 50 may be of any standard type and may receive water from the water line 22 which leads to a first interior portion 52 of the pressure reducing valve. The water then passes through a mesh filter 54 and through a restricted opening into a small chamber 56. A plug member 58 controls the amount of water which can leave the chamber 56 through an opening 60 from the chamber 56. A diaphram 62 controls the position of the plug 58 and with movement of the diaphram controlled in accordance with the operation of a screw 64 through a stiff spring 66.

By adjusting the position of the plug member 58, it is possible to adjust the pressure regulation of the valve 50. The water, when passing through the opening 60, goes into a chamber 68 and the relative sizes of the various chambers and openings within the valve 50 control the outlet pressure and with the position of the plug 58 adjusting this outlet pressure. The water at the outlet of the pressure reducing valve 50 is then passed to the water lines 24 and 26. It is to be appreciated that other types of pressure regulating valves may be used with the present invention and the invention is not to be limited to a specific type of pressure regulating valve.

Figure 4:
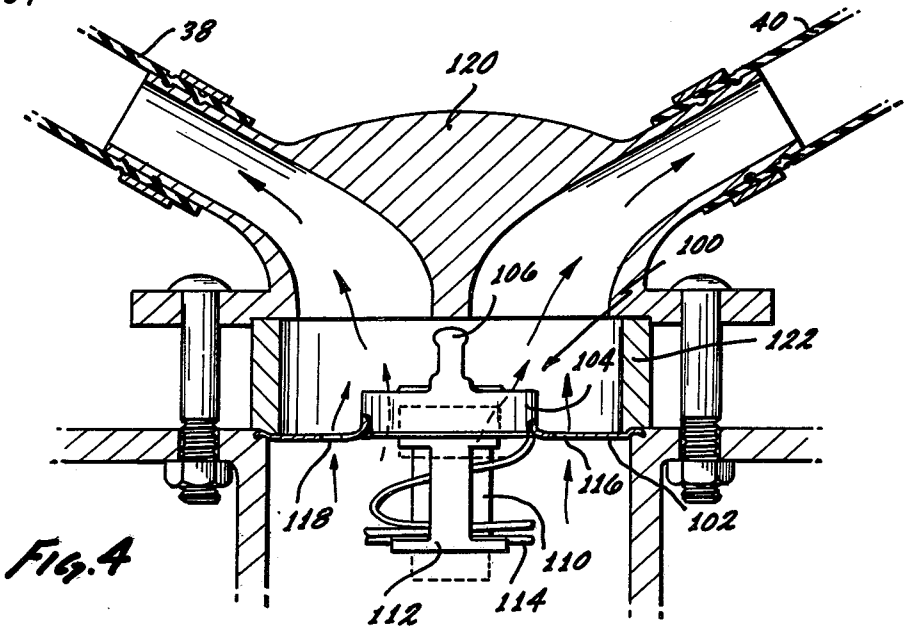
FIG. 4 illustrates a cross-sectional view of the thermostat installed at the exit point of the invention.
Figure 3:
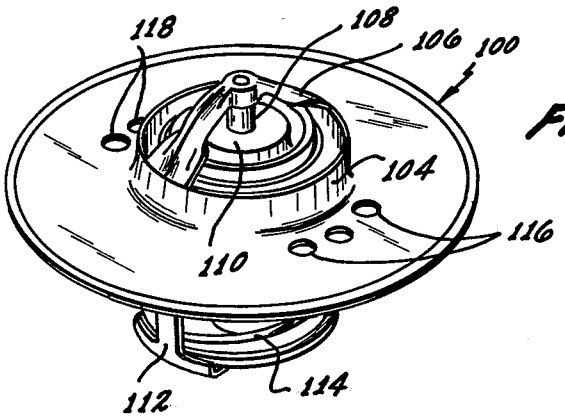
FIG. 3 is a perspective view of a thermostat modified to operate as part of the cooling system of the present invention.

Returning to FIGS. 1 and 5, the cooling system of the present invention also includes a thermostat 100 located at the exhaust exit for the coolant passing from the engine. A specific form of a thermostat which may be used is shown in FIG. 3 and the manner in which this thermostat may be positioned at the exhaust exit for the coolant is shown in FIG. 4. As shown in FIGS. 3 and 4, the thermostat 100 includes a flat plate 102 having a raised flanged portion 104 and with the plate 102 and a plug 110 acting as a barrier to the flow of water. The flanged portion 104 includes a bridge member 106 to act as an end support for a shaft member 108. The shaft member 108 passes into the plug member 110 and acts as a guide for movement of the plug member 110.

A second bridge portion 112 is disposed below the plate member 102 and supports a coil spring 114 which is disposed between the bridge 112 and an upper portion of the plug 110. The plug 110 is restrained from upper movement by the flange 104 and actually seats within the flange 104, but the plug 110 can move in the downward direction by overcoming the force of the spring 114. When the plug 110 is in the full upward position, the opening across the flange 104 is closed by the plug and no water flow can pass through the thermostat. If, however, the plug 110 moves in the downward direction against the spring 114 as shown in the dotted position in FIG. 4, then water may pass through the space between the plug 110 and the flange 104. This movement of the plug 110 may occur as the temperature increases wherein the movement of the plug 110 may be controlled either by a bimetallic element within the plug or by the expansion of a sealed gas within the plug 110.

It is to be appreciated that the thermostat 100 as shown in FIGS. 3 and 4 is of a particular type having a plug member controlling the passage of coolant through an opening in a plate. Other types of thermostats may be used. For example, the thermostat may be of a butterfly type having a vane member which pivots across an opening.

In order to ensure that the engine will pass a flow of water for mixture with the exhaust gases, even when the thermostat 100 calls for full closure of the thermostat plug 110, the thermostat of the present invention is modified through the use of openings 116 on one side of the plate 102 and openings 118 on the other side. These openings provide for a flow of water as shown in FIG. 4 so as to mix with the exhaust gases as shown in FIGS. 1 and 5. It is to be appreciated that these openings 116 and 118 may actually be a continuous opening and if a different type of thermostat is used, such as a butterfly type, the openings may be provided within the butterfly vane itself.

Turning to FIG. 4, it can be seen that the modified thermostat of FIG. 3 is installed within the coolant exit opening in the engine. In order to use the existing diverter structure such as structure 120 which splits the exhaust coolant to the two lines 38 and 40, a sleeve member 122 is used. It can be seen that the normal diverter structure 120 is removed and the thermostat 100 is positioned across the coolant exit. The sleeve member 122 is then positioned over the thermostat 100 and the diverter structure 120 is then repositioned on top of the sleeve member 122 to lock the thermostat 100 in position.

From the above description of the invention, it can be seen that the present invention is directed to a cooling system for marine engines which provides for an improved operation of these engines. Specifically, the cooling system of the present invention allows the engine to operate at an elevated temperature much closer to a desired operating temperature. The increased temperature of operation increases the durability of the engine and prolongs the engine life. The fuel consumption of the engine may be reduced and, in addition, the air pollution from the engine may be reduced.

Although the invention has been described with reference to an engine used in conjunction with a jet pump, it is to be appreciated that the cooling system of the present invention may be used with any type of marine engine which has a full flow of coolant through the engine. For example, such a system may be used in an in- and outboard type of system which includes a pump to supply a full flow of coolant through the engine.

It is to be appreciated that in addition to the adaptations and modifications indicated above, other adaptations and modifications may be made and the invention is only to be limited by the appended claims.

I claim:

1. A cooling system for marine engines for use in hydraulically propelling a boat and wherein the hydraulic propulsion system provides a flow of water to the engine for cooling and wherein the water is provided at a range of pressures including a high pressure substantially in excess of twenty-five pounds per square inch and wherein the flow of water from the engine is provided to the exhaust gases for cooling the exhaust gases, the cooling system, including, a pressure regulator for receiving the complete flow of cooling water from the hydraulic propulsion system and for providing this complete flow of water to the engine for cooling and with the pressure regulator providing the complete flow of water to the engine at a pressure substantially less than the high pressure from the propulsion system, a thermostat located to receive water from the engine and for regulating the complete flow of water from the engine to the exhaust gases in accordance with the temperature of the water from the engine, and the thermostat providing a minimum complete flow of water from the engine to the exhaust gases even when the water is at its coldest temperature.

2. The cooling system of claim 1 wherein the pressure regulator provides the flow of water to the engine at a pressure in the range of fifteen to twenty-five pounds per square inch.

3. The cooling system of claim 1 wherein the thermostat in the closed position includes an opening to provide for the minimum flow.

4. A marine engine for propelling a boat and wherein the propulsion system provides a flow of water to the engine for cooling and wherein the water is provided at a range of pressures including a high pressure substantially in excess of twenty-five pounds per square inch and wherein the flow of water from the engine provides cooling of the exhaust gases, including, a marine engine having a cooling system including an inlet and an outlet, an inlet water line coupling the complete flow of cooling water from the propulsion system to the inlet of the engine for directing the complete flow of water to the engine for cooling, a pressure regulator located in the inlet water line for regulating the pressure of the complete flow of water to the engine at a level substantially less than the high pressure from the propulsion system, an outlet water line coupled to the outlet of the engine for directing the complete flow of water from the engine for cooling the exhaust gases, a thermostat located in the outlet water line for regulating the complete flow of water from the engine in accordance with the temperature of the water from the engine to regulate the operating temperature of the engine at a desired level, and wherein the thermostat in the closed position provides for a particular minimum flow of water from the engine.

5. The marine engine of claim 4 wherein the pressure regulator provides a level in the range of fifteen to twenty-five pounds per square inch.

6. The marine engine of claim 4 wherein the thermostat includes an opening to provide for the particular minimum flow.

7. The marine engine of claim 4 wherein the flow of water from the engine is mixed with exhaust gases from the engine.

8. The marine engine of claim 4 wherein the operating temperature of the engine is regulated to be between 150° F to 190° F for operation in fresh water and to be below 140° F for operation in salt water.

* * * * *